US005261535A

United States Patent [19]

Light et al.

[11] Patent Number: 5,261,535

[45] Date of Patent: Nov. 16, 1993

[54] FLEXIBLE PHOTOGRAPHIC FILM PACKAGE

[75] Inventors: Susan L. Light, Webster; William G. Hoyt, Churchville; Alan E. Hoak; Richard N. Palczyk, both of Rochester, all of N.Y.

[73] Assignee: Eastman Kodak Company, Rochester, N.Y.

[21] Appl. No.: 890,893

[22] Filed: May 29, 1992

[51] Int. Cl.[5] ..... B65D 85/67

[52] U.S. Cl. ..... 206/391; 206/476; 206/485; 206/487

[58] Field of Search ..... 206/391, 397, 408, 476, 206/479, 483, 485, 487, 490, 497, 434

[56] References Cited

U.S. PATENT DOCUMENTS

| | | | |
|---|---|---|---|
| 1,759,079 | 5/1930 | Wolf et al. | 206/487 |
| 2,814,385 | 11/1957 | Stone | 206/434 |
| 2,828,008 | 3/1958 | Fryburger | 206/485 |
| 3,144,343 | 8/1964 | Fritsche | 99/179 |
| 3,184,319 | 5/1965 | Fritsche | 99/171 |
| 3,198,329 | 8/1965 | Golenpaul et al. | 206/486 |
| 3,246,746 | 4/1966 | Holley | 206/486 |
| 3,439,798 | 4/1969 | James | 206/149 |
| 3,682,597 | 8/1972 | Husch | 206/485 |
| 3,700,089 | 10/1972 | Halbartschlager et al. | 198/1 |
| 4,051,265 | 9/1977 | Kirshenbaum | 206/497 |
| 4,449,631 | 5/1984 | Levenberg et al. | 206/497 |
| 4,723,655 | 2/1988 | Schreiber | 206/408 |
| 4,782,956 | 11/1988 | Yoshizawa | 206/497 |
| 4,852,732 | 8/1989 | Wilski et al. | 206/204 |
| 5,020,660 | 6/1991 | Akerley et al. | 206/397 |
| 5,020,669 | 6/1991 | Nakagoshi | 206/466 |
| 5,048,687 | 9/1991 | Suzuki et al. | 206/497 |

FOREIGN PATENT DOCUMENTS

| | | | |
|---|---|---|---|
| 256237 | 2/1988 | European Pat. Off. | 206/391 |
| 1336171 | 7/1963 | France | 206/485 |
| 825578 | 12/1959 | United Kingdom | 206/391 |

*Primary Examiner*—David T. Fidei
*Attorney, Agent, or Firm*—Clyde E. Bailey

[57] ABSTRACT

A package system 10 for storing and transporting photographic film products in an environment substantially free of dirt, light and moisture has a support member 12 comprising a first portion 14, a medial portion and a second portion 16. The first and second portions 14,16 each comprise a plurality of spaced openings 24 for receiving a partial portion of the product in a substantially locked relation with the first and second portions 14,16, respectively to restrict translational movement of the product in the support member 12. A pair of spaced single foldable scored lines 17,19 in the medial portion of the support member 12 forms an end wall 20 therebetween that spatially separates the first portion 14 from the second portion 16. When product are nested in the first portion 14 of the support member 12 and the second portion 16 is brought into folded engagement with the an opposite portion of the nesting product, a container 30 is formed. The container 30 is then overwrapped and hermetically sealed with a flexible light shielding and moisture impervious barrier material to form the package 10.

3 Claims, 8 Drawing Sheets

FLEXIBLE PHOTOGRAPHIC FILM PACKAGE

FIELD OF THE INVENTION

The invention relates generally to a package system, and more particularly to a flexible package for storing and transporting one or more photosensitive film products substantially free of dirt, moisture and light.

BACKGROUND OF THE INVENTION

Conventional 135 film magazine packages have both a primary and secondary package structure. Product protection and user utility are provided by the primary package structure which is typically a combination opaque can and cap arrangement. The can and cap combination provides a barrier to light, moisture, and dirt such that the film contained therein is fit for use by the photographer. Another function of the can is to protect the film leader and magazine from abrasion. The secondary package structure is typically a carton that imparts stackability and offers product advertisement and communication opportunities. The can and cap combination is loaded into various carton configurations to provide various sale quantities to the customer.

Photographers on location using multiple film rolls often discard the conventional packaging, given its bulky nature, rather than saving it on their person as a carrying device for exposed film rolls. Thus, the present combination of cans, caps and cartons results in enormous amounts of packaging waste with which the consumer must contend. Moreover, professional photographers using 135 film products have unique requirements related to convenience of use. These requirements typically involve the need to carry multiple rolls of film products, the need to access those film products quickly for camera loading in fast action settings, and the need to conveniently retain and contain the exposed film on their person. Thus, with the present 135 film packages, the photographer can not easily maintain control of exposed film magazine and must find a convenient place to store exposed film magazines. Prior art packages complicate this use requirement because of their inherently bulky and complex nature.

For many years, packaging engineers have developed packaging systems intended to eliminate one or more of the aforementioned problems. For instance, U.S. Pat. No. 4,852,732 discloses a packaging system having a receptacle for containing a desiccant disposed therein for protecting a photoresist material from the effects of moisture. Rigid packages for transporting multiple food product items are disclosed in U.S. Pat. Nos. 3,184,319, and 3,144,343 which utilize a rigid plastic top and bottom frames having cut outs for overlying a portion of a packaged product.

Despite the limited success demonstrated by prior art inventors, there persists the need for a package system that is convenient to use and can store and transport multiple products in a flexible overwrap material that provides product protection from the deleterious effects of light, moisture and dirt.

SUMMARY OF THE INVENTION

It is, therefore, the object of the invention to provide a flexible package system having improved convenience of use while protecting the enclosed product from moisture, light and dirt.

Accordingly, for accomplishing these and other objects of the invention, there is provided a package system for storing and transporting articles of manufacture having outwardly extending end portions, the system comprising an article support member. The article support member includes a first portion having a plurality of spaced openings for partially receiving the articles, the spaced openings having a length and a width, the length corresponding substantially to the length of one of the articles and the width substantially less than the width of one the articles. Means are disposed along the width of the openings for engaging the end portions of the articles in a substantially locked relation with the spaced openings thereby restricting rotational movement of the articles nesting in the first portion. The medial portion of the article support member has a pair of single spaced foldable scored lines defining edges of an end wall therebetween for spatially separating the first portion from a second portion. The second portion has a plurality of spaced openings for partially receiving an opposite portion of the articles, the spaced openings having a length and a width, the length corresponding substantially to the length of one of the articles and the width substantially less than the width of one the articles. Means are disposed along the width of the openings for engaging the end portions of the articles in a locked relation with the spaced openings thereby restricting rotational movement of the articles in the second portion. Thus, when the second portion is brought into folded engagement with the articles nesting in the first portion, an article container is formed. A flexible light shielding and moisture barrier material is wrapped and hermetically sealed about said article container to provide protection for the articles.

DETAILED DESCRIPTION OF THE INVENTION

Figure 1:
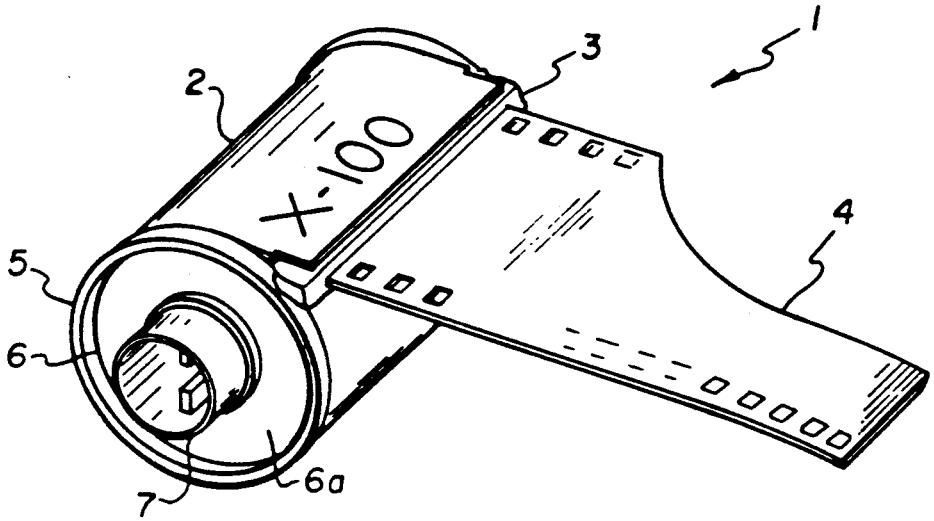
FIG. 1 is a perspective view of a 135 film magazine.

Film magazines adaptable to the package system of the present invention include 135 film. FIG. 1 shows a perspective view of a 135 film magazine 1 having a retort 2 for protecting the photosensitive film and spaced lips 3 through which a film leader portion 4 projects for interaction with a camera. The projected leader portion 4 is protected from damage in the package of the invention as described below. Moreover, film magazine 1 has a pair of endcaps or portions 5 (only one shown) each having an outwardly and peripherally extending wall 6 surrounding a recessed annular surface 6a. A film spool hub 7 extends axially through a hole in each magazine from one of the endcap. A more complete description of the 135 film is provided in U.S. Pat. No. 2,940,232, incorporated herein by reference.

Figure 2:
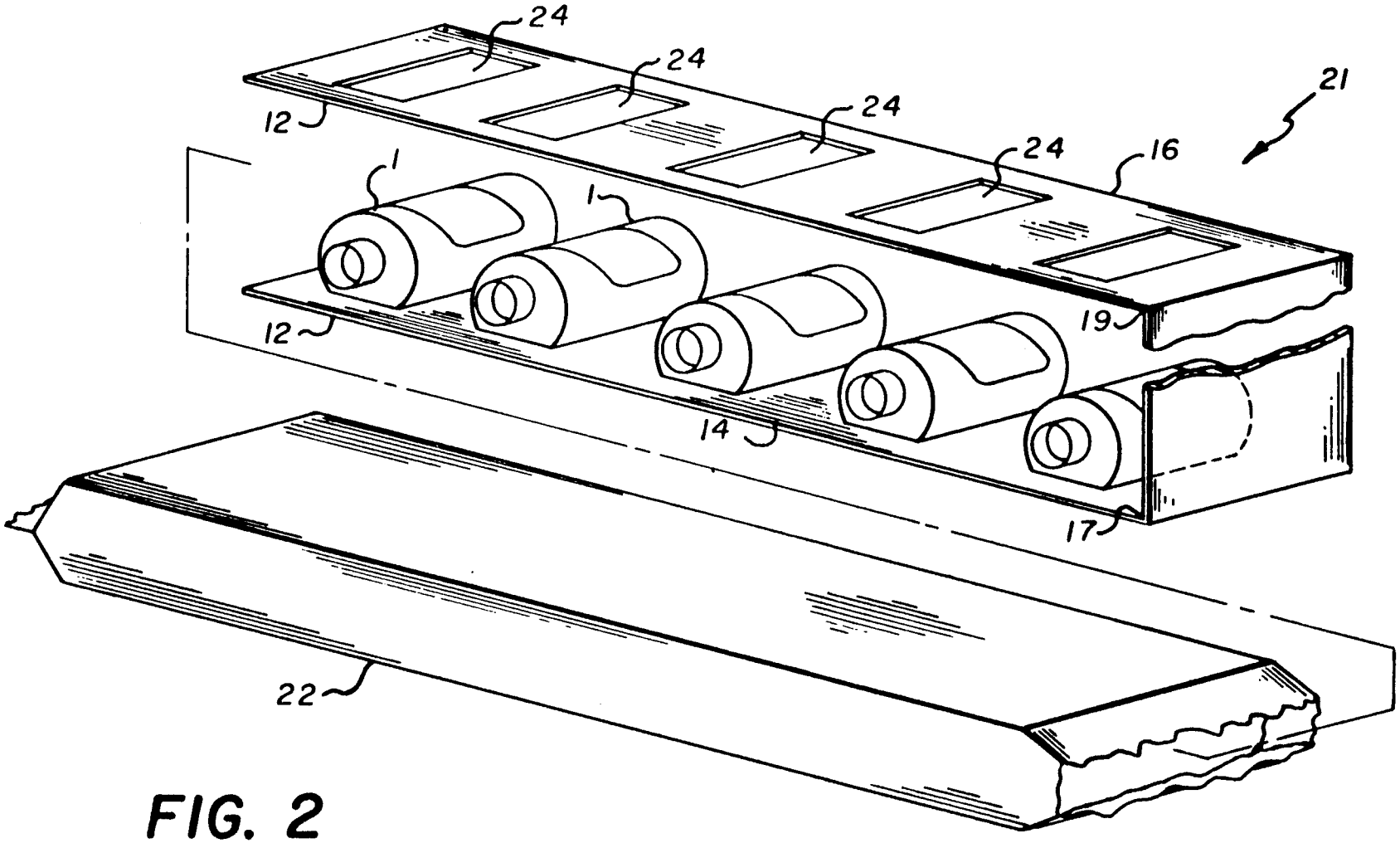
FIG. 2 is an exploded perspective view of one embodiment of the package system made in accordance with the invention.
Figure 3:
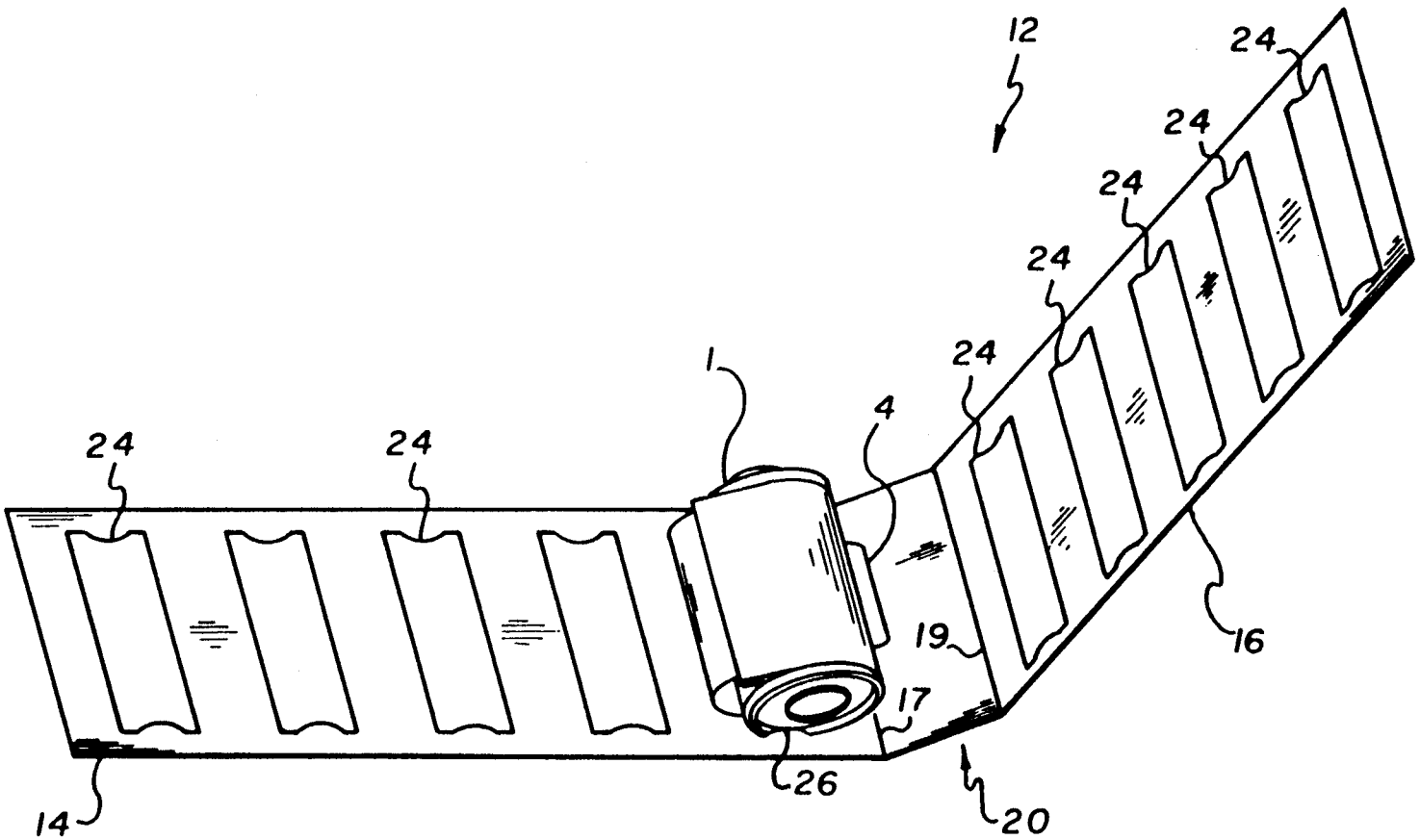
FIG. 3 is a plan view of the article support member of the invention.
Figure 4:
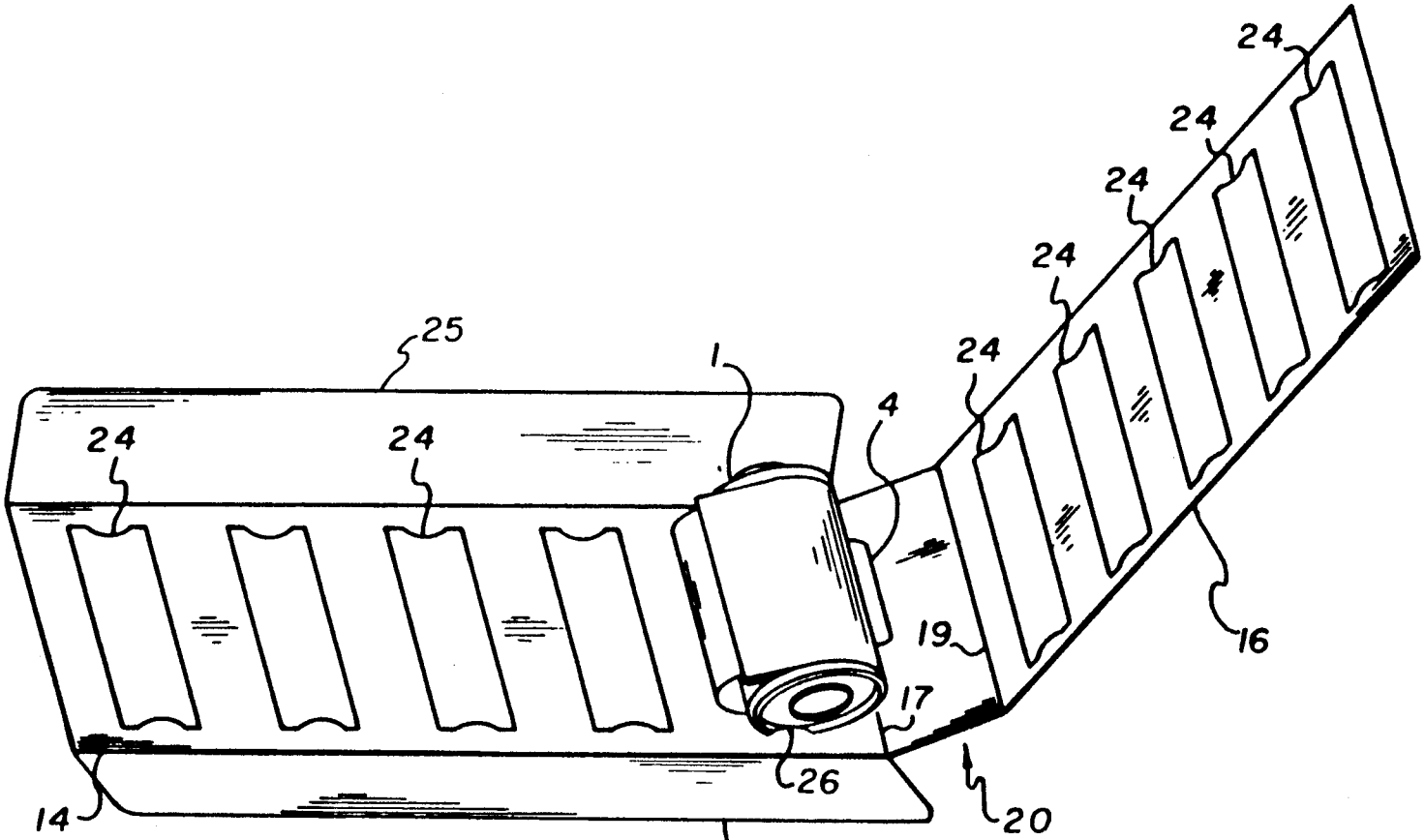
FIG. 4 is a plan view of an alternative embodiment of the article support member with product exposed therein.
Figure 4A:
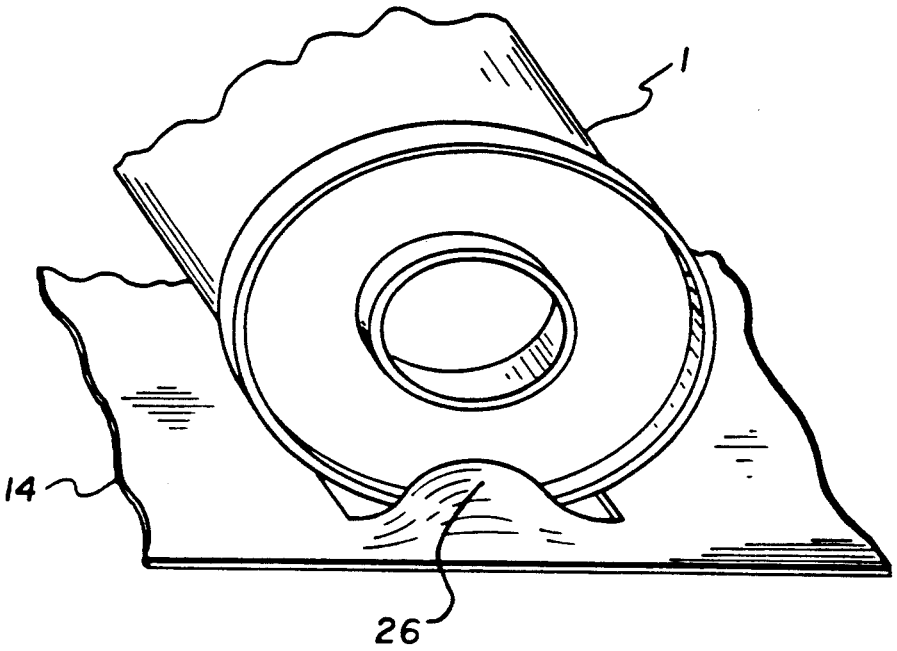
FIG. 4*a* is an enlarged partial perspective view of the article retention mechanism.

Turning now to FIG. 2, an exploded view of the package system is shown constructed in accordance with the principles of the invention. Generally package 10 comprises an article support member 12 having a first portion 14 and a second portion 16. A medial portion having spaced scored lines 17,19 separates the first and second portions 14,16 (FIGS. 3 & 4). Spaced scored lines 17,19 form an end wall 20 of an article container 21 when the second portion 16 is brought into folded engagement with the articles nesting in the first portion 14, as further described hereinbelow. A flexible barrier material layer 22 (FIGS. 8 & 9) is then wrapped and hermetically sealed about the article container 21 to form the package 10 of the invention, as described in greater details below.

Figure 5:
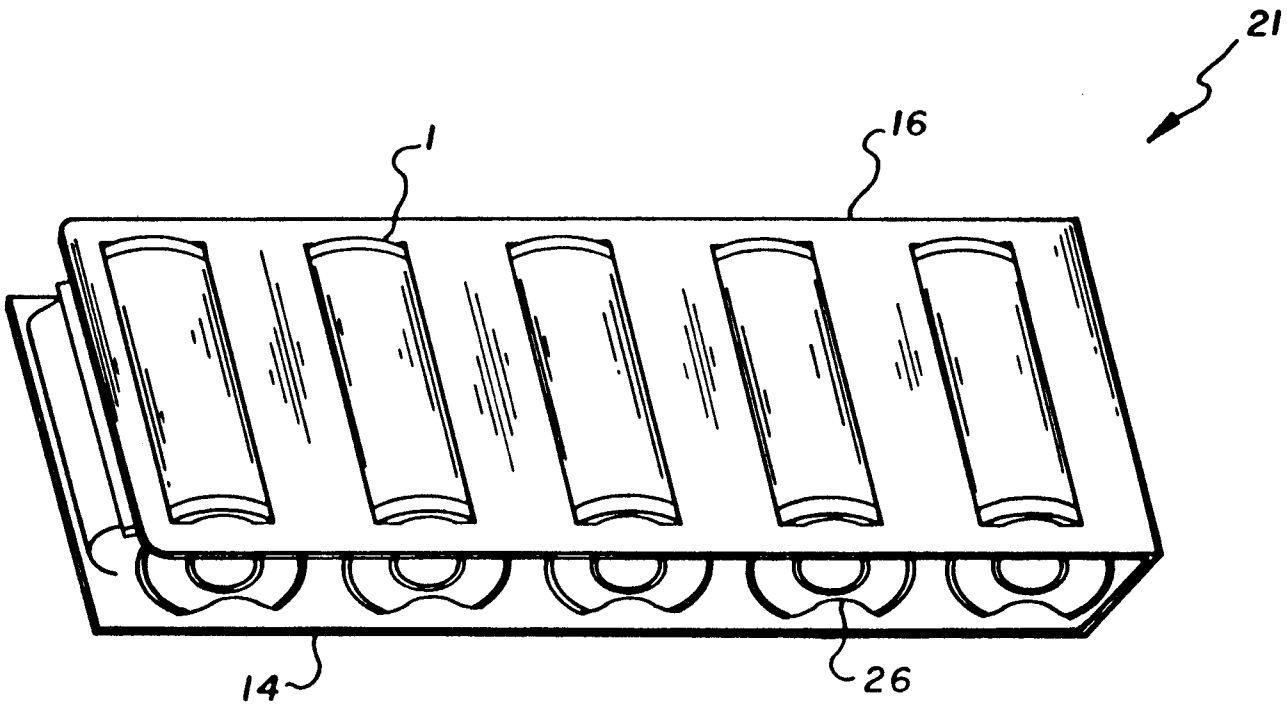
FIG. 5 is a perspective view of the container of the invention exposing product.
Figure 6:
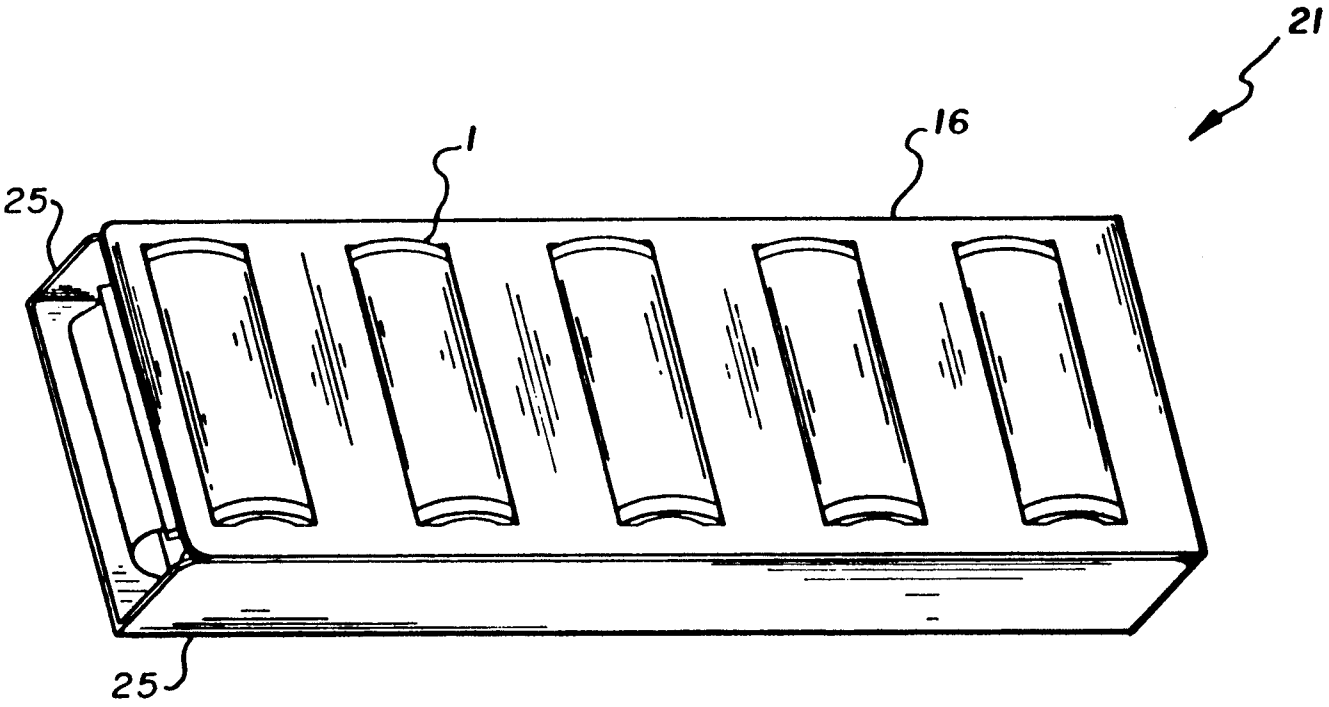
FIG. 6 is a perspective view of an alternative embodiment of the container with product exposed therein.

As shown clearly in FIGS. 3-5, the article support member 12 comprises a first and second portions 14,16, each having a plurality of spaced openings 24 for receiving and retaining articles, such as 135 photographic film magazines. Although package 10 is described as a container for photographic film magazines, it will be appreciated that the package 10 can be utilized for other types of articles. The length of spaced openings 24 is substantially equal to the length of the articles contained therein. The width of the spaced openings 24 is substantially less than the width of the articles enclosed such that only a small peripheral portion of the article may be pressed fitted into the openings 24 and the article cannot pass through the spaced openings 24. The end wall 20 of the container formed by the foldable scored lines 17,19 in the medial portion of the support member 12 has a length preferably greater than the length of the articles and a width somewhat less than the width of the articles. The end wall 20 provides protection for the film magazine leader that projects from the magazine positioned nearest to end wall 20.

Figure 7:
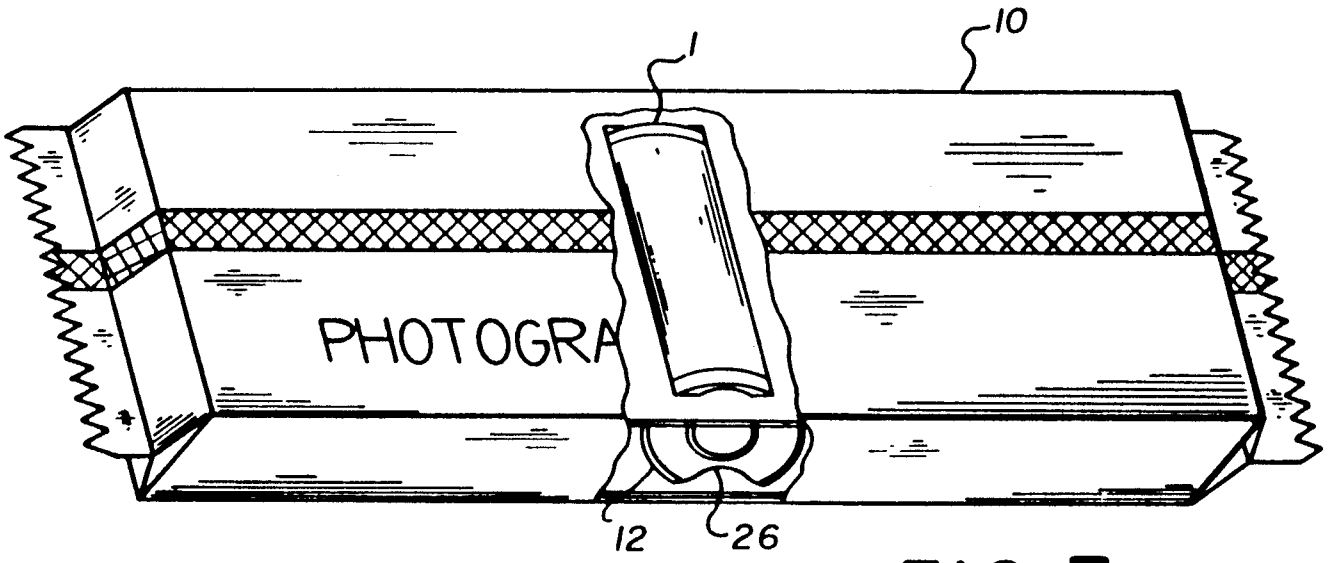
FIG. 7 Is a fragmented perspective view of the package system of the invention.

In an alternative embodiment of the invention, first portions 14 have sidewalls 25, as shown in FIGS. 4 & 7, extending longitudinally along their lengths to provide rigidity and form to the package system 10. Sidewalls 25 preferably have a width somewhat less than the width of the product contained in the package 10 for best utility.

Further, a means for substantially locking the article in the spaced openings 24 is provided in the package 10 of the invention. In a preferred embodiment of the invention, tab portions 26, as shown more clearly in FIG. 5, are formed in the widths of the spaced openings 24 and projected inwardly of the spaced openings 24 so as to engage the outwardly extending walls 6 (FIG. 1) of the end portions 4,5 of the article nesting therein. Thus, during transporting, the product is restricted to non-interfering rotational movement in the container formed when the second portion 16 of the support member 12 is brought into folded engagement with the articles nesting in the first portion 14. Rotational movement of the magazines is restricted when the spaced lips 3 and leader portion 4 of the film magazine 1 is pressed against either the first or second portions 14,16 of the support member 12. Hence, in this package system, abrasions and other damage to the product contained therein is prevented since adjacently positioned product cannot be deflected into other contained product or move laterally in their respective spaced openings 24 in the first and second portions 14,16 of the support member 12.

Thus, in another embodiment of the invention, a mechanism for locking an article in a package system 10 of the invention as described above, comprises means disposed along the width of the spaced openings 24 of the first and second portions 14,16 for engaging the end portions of the products in a locked relation with the spaced openings 24 thereby restricting rotational movement of the products in the first and second portions 14,16. Those skilled in the art will appreciate that other means for locking the articles in the spaced openings 24 within the requirements of the invention may be used.

Support member 12 is made of a flexible recycled boardstock material, such as clay coated newsback. Alternative materials include solid bleached sulfate chipboard, or other materials of adequate strength and rigidity. The recycled boardstock comprising the support member 12 has a thickness from about 0.016 inches to about 0.050 inches, preferably from about 0.020 inches to about 0.030 inches.

Figure 8:
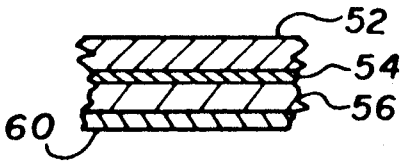
FIG. 8 is a partial sectional view of the flexible barrier overwrap material structure of the invention.

Turning now to FIG. 8 and 9, the package system 10 according to the invention has a flexible light shielding and moisture barrier overwrap layer 50 hermetically sealed thereabout. In the preferred embodiment, the overwrap layer 50 is a laminated structure, as shown in FIG. 8, comprising an outer layer 52 of either polypropylene, polyester, nylon, or cellophane. Those skilled in the art will appreciate that the outer layer 52 could be just about any material that is flexible and provides strength within the requirements of the invention. An adhesive layer 54 bonds the outer layer 52 to an inner layer 56 comprising aluminum foil. The aluminum foil provides both moisture and light barrier protection to the package system 10 of the invention. Alternatively, a vacuum metallized layer can be used in the place of aluminum foil. An adhesive layer 58 bonds the aluminum foil layer 56 to an innermost sealant layer 60. Suitable materials that can be used as both the adhesive and the sealant are ethylene-vinyl acetate (EVA), ethylene-ethyl acrylate (EEA), ethylene-methyl acrylate (EMA), ethylene-ethyl acrylate acid (EAA), low density polyethylene (LDPE) and any combination thereof.

Thus, in another embodiment of the invention, an article of manufacture, comprises a photographic product and the package 10 of the invention, as described above, for the photographic product.

To secure articles in the package system 10 of the invention, therefore, the articles are placed in the spaced openings 24 of the first portion 14 of the flexible article support member 12 such that the end portions of the articles are engaged by the inwardly projecting tabs 26 in the width of the spaced openings 24 (FIG. 3,4, 4a)). The flexible support member 12 enables the tabs 26 in the widths of the spaced openings 24 to flex over the extending end portions of the article. The second portion 16 of the support member 12 is then brought into folded engagement with the opposite portion of the articles nesting in the first portion 14 of the support member 12 such that an article container 30 is formed. Thereafter, a flexible light shielding and moisture barrier material is wrapped and hermetically sealed about the article container 30 to provide protection for the articles contained therein. Access to the interior compartment of the container 30 to permit removal of at least one article is achieved by tearing the overwrap material at a predetermined weakness in the overwrap material, lifting the second portion 16 of the support member 12 away from the article(s) and, withdrawing the article(s) from the first portion 14 of the container 30.

The invention has thus been described with reference to certain preferred embodiments thereof but it will be understood that variations and modifications can be effected within the spirit and scope of the invention.

What is claimed is:

1. A package system containing an article of manufacture having outwardly extending end portions, the package system comprising:

a) an article support member comprising first, medial and second portions;

b) and wherein said first portion comprises at least one spaced opening for partially receiving said article, said spaced opening having a length and a width, said length corresponding substantially to the length of said article and said width substantially less than the width of said article; and wherein, means are disposed along said width of said spaced opening for engaging said outwardly extending end portions of said article in a substantially locked relation with said spaced opening thereby restricting axial movement of said article nesting in said first portion;

c) and wherein said medial portion comprises a pair of single spaced foldable scored lines forming edges of an end wall therebetween for spatially separating said first portion from said second portion;

d) and wherein said second portion comprises at least one opposed spaced opening for partially receiving an opposite portion of said article, said opposed spaced openings having a length and a width, said length corresponding substantially to the length of said article and said width substantially less than the width of one said article; and wherein, means are disposed along said width of said opposed spaced opening for engaging said outwardly extending end portions of said article in a locked relation with said opposed spaced opening thereby restricting translational movement of said article in said second portion; and wherein said second portion is brought into folded engagement with said article nesting in said first portion to form an article container; and, e) a flexible light shielding and moisture impervious barrier material wrapped and hermetically sealed about said article container to provide protection of said article, said flexible material having a laminated structure comprising:

i) a first layer comprising an oriented extruded or co-extruded flexible film material having a front side capable of receiving reverse or surface printed information and a back side;

ii) a second layer comprising a light barrier and moisture impervious material, said second layer being laminated to the back side of said first layer; and iii) a third layer comprising a resin extrudate material, said extrudate material being bonded to said second layer.

2. The package recited in claim 1 wherein said article support member is made of a recycled boardstock or solid bleached sulfate chipboard.

3. An article of manufacture, comprising:

a) a film magazine having outwardly extending end portions; and, b) a package for said film magazine, including:

i) a support member comprising first, medial and second portions;

ii) and wherein said first portion comprises at least one spaced opening for partially receiving said film magazine, said spaced opening having a length and a width, said length corresponding substantially to the length of said film magazine and said width substantially less than the width of said film magazine; and wherein, means are disposed along said width of said opening for engaging said outwardly extending end portions of said film magazine in a substantially locked relation with said spaced opening thereby restricting rotational movement of said film magazine nesting in said first portion;

iii) and wherein said medial portion comprises a pair of single spaced foldable scored lines forming edges of an end wall therebetween for spatially separating said first portion from said second portion;

iv) and wherein said second portion comprises at least one opposed spaced opening for partially receiving an opposite portion of said film magazine, said opposed spaced opening openings having a length and a width, said length corresponding substantially to the length of said film magazine and said width substantially less than the width of said film magazine; and wherein, means are disposed along said width of said opposed spaced opening for engaging said outwardly extending end portions of said film magazine in a locked relation with said opposed spaced opening thereby restricting rotational movement of said film magazine in said second portion; and wherein said second portion of said support member is brought into folded engagement with said film magazine. nesting in said first portion to form a film magazine container; and, v) a flexible light shielding and moisture impervious barrier material wrapped and hermetically sealed about said film magazine container to provide protection for said film magazine, said flexible material having a laminated structure comprising: a first layer comprising an oriented extruded or co-extruded flexible film material having a front side capable of receiving reverse or surface printed information and a back side; a second layer comprising a light barrier and moisture impervious material, said second layer being laminated to the back side of said first layer; and, a third layer comprising a resin extrudate material, said extrudate material being bonded to said second layer.

* * * * *